US008935997B2

(12) United States Patent
Foege

(10) Patent No.: US 8,935,997 B2
(45) Date of Patent: Jan. 20, 2015

(54) ENGINE AND VENTILATION SYSTEM FOR AN ENGINE

(71) Applicant: Electro-Motive Diesel, Inc., Lagrange, IL (US)

(72) Inventor: Aaron Gamache Foege, Westmont, IL (US)

(73) Assignee: Electro-Motive Diesel, Inc., Lagrange, IL (US)

( * ) Notice: Subject to any disclaimer, the term of this patent is extended or adjusted under 35 U.S.C. 154(b) by 35 days.

(21) Appl. No.: 13/832,894

(22) Filed: Mar. 15, 2013

(65) Prior Publication Data

US 2014/0261260 A1 Sep. 18, 2014

(51) Int. Cl.
*F02M 25/08* (2006.01)
*F01M 13/00* (2006.01)

(52) U.S. Cl.
CPC ..... *F01M 13/0011* (2013.01); *F02M 25/0836* (2013.01); *F02M 25/089* (2013.01)
USPC ..... 123/41.86; 123/572; 123/573; 123/574

(58) Field of Classification Search
CPC ..... F02M 25/089; F02M 25/0872; F02M 35/1022; F01M 13/00; F01M 13/04–13/0416; F01M 13/025; F01M 13/023; F02D 41/1439
USPC ..... 123/41.86, 572–574
See application file for complete search history.

(56) References Cited

U.S. PATENT DOCUMENTS

| | | | | |
|---|---|---|---|---|
| 4,020,809 | A | 5/1977 | Kern et al. | |
| 4,682,571 | A | 7/1987 | Kaufman et al. | |
| 4,945,868 | A | 8/1990 | Klomp | |
| 5,357,919 | A | 10/1994 | Ma | |
| 5,558,070 | A | 9/1996 | Bell et al. | |
| 5,628,295 | A | 5/1997 | Todero et al. | |
| 5,722,376 | A * | 3/1998 | Sweeten | 123/574 |
| 6,173,683 | B1 | 1/2001 | Nemoto et al. | |
| 7,159,386 | B2 | 1/2007 | Opris | |
| 7,320,316 | B2 * | 1/2008 | Moncelle et al. | 123/572 |
| 7,826,987 | B2 * | 11/2010 | Aikawa | 702/50 |
| 8,141,545 | B2 * | 3/2012 | Matsuura et al. | 123/572 |
| 2007/0068141 | A1 | 3/2007 | Opris et al. | |

FOREIGN PATENT DOCUMENTS

| | | |
|---|---|---|
| JP | 10159662 | 6/1998 |
| WO | WO 94/28299 | 12/1994 |

* cited by examiner

*Primary Examiner* — Lindsay Low
*Assistant Examiner* — Kevin Lathers
(74) *Attorney, Agent, or Firm* — Finnegan, Henderson, Farabow, Garrett & Dunner LLP

(57) ABSTRACT

A ventilation system for an engine is disclosed. The ventilation system may include a first conduit configured to connect an exhaust system of the engine with a crankcase of the engine, a second conduit configured to connect to a vent of the crankcase, and a valve disposed within the second conduit. Additionally, the ventilation system may include a sensor configured to generate a signal indicative of a concentration of a gaseous constituent within the crankcase of the engine, and a controller in communication with the valve and the sensor, the controller being configured to selectively move the valve based on the signal.

16 Claims, 1 Drawing Sheet

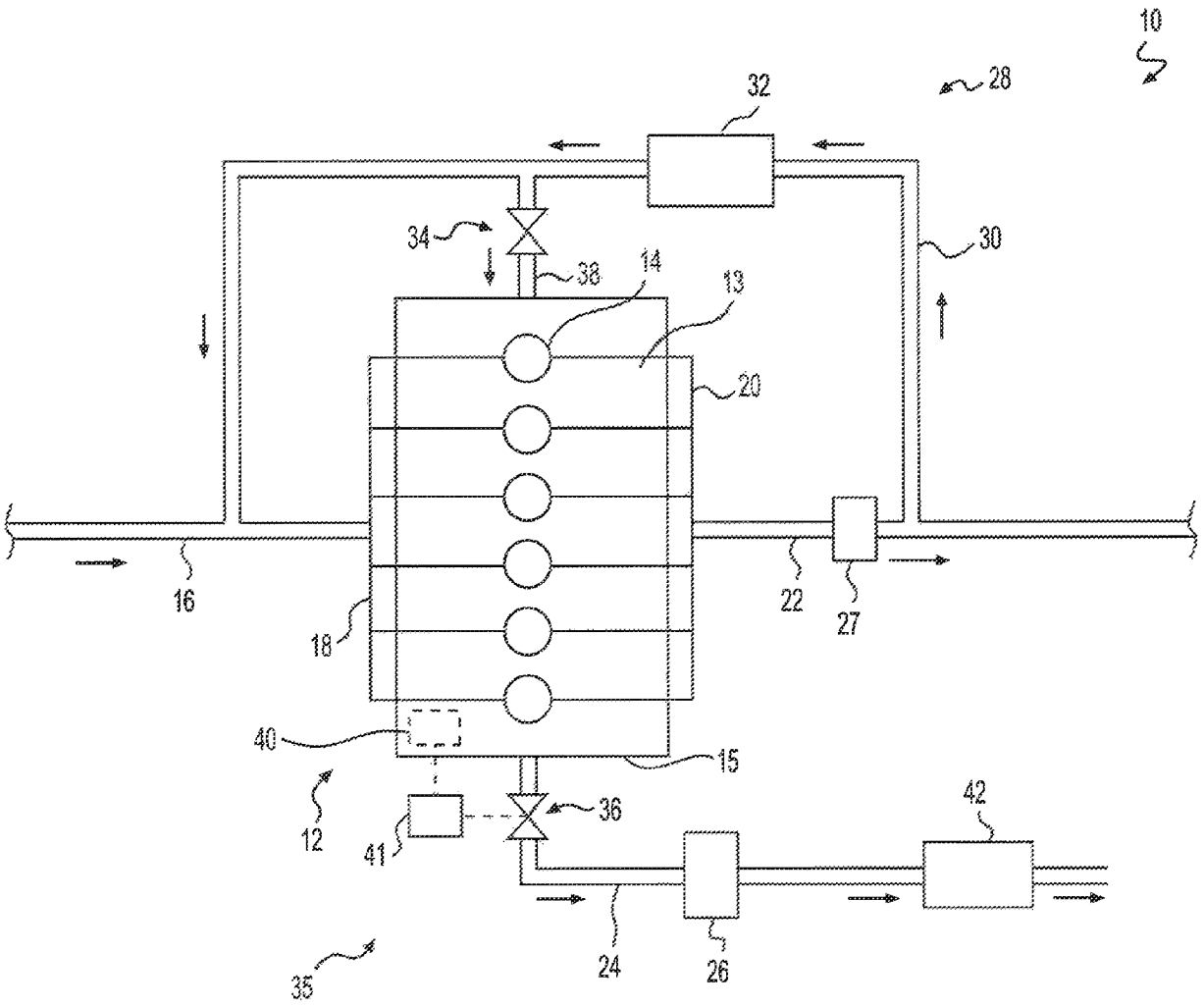
10
28
30
32
13
20
14
38
34
22
27
15
36
42
26
24
41
40
12
35
18
16

ENGINE AND VENTILATION SYSTEM FOR AN ENGINE

TECHNICAL FIELD

The present disclosure relates generally to an apparatus and method for an internal combustion engine, and, more particularly, to an apparatus and method for purging an engine crankcase.

BACKGROUND

In internal combustion engines, including diesel and gasoline engines, a fuel and air mixture is combusted in combustion cylinders. Reciprocating pistons in the combustion cylinders are moved between top dead center and bottom dead center positions by a crankshaft positioned below the cylinders in a crankcase. As each piston moves toward its top dead center position, it compresses the fuel and air mixture in the combustion chamber above the piston. The compressed mixture combusts and expands, driving the piston downward toward its bottom dead center position.

The exhaust gases of the engine are typically released from the combustion cylinders of the engine into the atmosphere through an exhaust stack or tailpipe. These exhaust gases, however, may contain a complex mixture of air pollutants generated as byproducts of the combustion process, and it may be desirable to reduce the amount of such pollutants being released into the atmosphere. Due to increased attention on the environment, exhaust emission standards have become more stringent. The amount of pollutants emitted to the atmosphere from an engine can be regulated depending on the type of engine, size of engine, and/or class of engine.

One method that has been implemented by engine manufacturers to comply with the regulation of exhaust emissions includes utilizing an exhaust gas recirculation (EGR) system. EGR systems typically operate by recirculating a portion of the exhaust gas produced by the engine back to the intake of the engine to mix with fresh combustion air. The resulting mixture may produce a lower combustion temperature and, subsequently, generate a reduced amount of regulated pollutants.

Instead of being exhausted from the engine, however, some of the combustion byproducts may enter into the crankcase by blowing past seal rings around the pistons, and may thus be referred to as "blow-by gases" or simply "blow-by." Blow-by gases may contain contaminants normally found in exhaust gases, such as hydrocarbons (HC), carbon monoxide (CO), $NO_x$, soot, and unburned or partially burned fuel. Because the crankcase is partially filled with lubricating oil, which is in contact with hot engine components, and agitated at high temperatures, the blow-by gases may also contain oil droplets and oil vapor. In addition, the crankcase may contain a concentration of one or more gaseous constituents, such as oxygen contained in air within the crankcase.

As blow-by gases accumulate in the crankcase, the crankcase may be ventilated to remove the blow-by gases to relieve pressure in the crankcase, and to remove an amount of a gaseous constituent (e.g. oxygen) from the crankcase. Some systems vent the blow-by gases directly to the atmosphere. However, because the contaminants in blow-by gases can harm the environment, other crankcase ventilation options have been explored. For example, U.S. Pat. No. 7,159,386 to Opris ("Opris") discloses a crankcase ventilation system for an internal combustion engine, whereby crankcase exhaust gases are routed to a main exhaust conduit extending from an engine exhaust manifold. In particular, crankcase exhaust gases merge with the main exhaust conduit downstream of a particulate trap disposed in the main exhaust conduit. According to Opris, because the pressure of the exhaust gases in the main exhaust conduit downstream from the particulate trap may be lower than the pressures within the crankcase of the engine, crankcase exhaust gases may flow from the crankcase to the main exhaust conduit without the aid of a pump.

The crankcase ventilation system described by Opris also includes an EGR system that may extract main exhaust gases from the main exhaust gas conduit, and direct the extracted main exhaust gases back to an air intake to be reintroduced into combustion chambers of the engine. The exhaust gases that flow through the EGR system disclosed by Opris, however, are not routed through the crankcase for crankcase ventilation.

As noted above, crankcase ventilation may be used to remove exhaust gas, along with one or more gaseous constituents, from the crankcase. Because oil droplets and oil vapor may accumulate in the crankcase during normal engine operation, oil vapor may be exhausted into the atmosphere during ventilation, contributing to exhaust emissions. While an oil filtering device, such as an oil separator, may be incorporated into a crankcase ventilation system to minimize oil vapor being emitted into the atmosphere, some oil vapors may still be exhausted into the atmosphere.

The disclosed engine system and method are directed to overcoming one or more of the problems set forth above and/or other problems of the prior art.

SUMMARY

In one aspect, a ventilation system is disclosed. The ventilation system may include a first conduit configured to connect an exhaust system of the engine with a crankcase of the engine, a second conduit configured to connect to a vent of the crankcase, and a valve disposed within the second conduit. Additionally, the ventilation system may include a sensor configured to generate a signal indicative of a concentration of a gaseous constituent within the crankcase of the engine, and a controller in communication with the valve and the sensor, the controller being configured to selectively move the valve based on the signal.

In another aspect, an engine is disclosed. The engine may include an engine block, and a cylinder head connected to the engine block and, together with the engine block, at least partially defining a cylinder. A crankcase may be connected to the engine block opposite the cylinder head. The engine may further include an exhaust system fluidly connected to the cylinder, and a vent fluidly connected to an interior of the crankcase. Additionally, a first conduit may be fluidly connected between the exhaust system and the crankcase, and a second conduit may be fluidly connected to the vent.

In yet another aspect, a method of purging an engine crankcase is disclosed. The method may include directing a flow of exhaust from an engine into the engine crankcase, sensing a concentration of a gaseous constituent within the engine crankcase, and selectively restricting the flow of exhaust out of the crankcase based on the concentration.

BRIEF DESCRIPTION OF THE DRAWINGS

FIG. 1 is a schematic representation of an engine system according to an exemplary disclosed embodiment.

DETAILED DESCRIPTION

FIG. 1 illustrates an exemplary internal combustion engine 10 having a ventilation system. The engine 10 may be for any type of internal combustion engine, such as a two-stroke or four-stroke gasoline or diesel engine. Additionally, the engine may be naturally aspirated or may include forced induction such as turbocharging or supercharging.

The engine 10 may include an engine block 12, and a cylinder head 13 connected to the engine block 12, and, together with the engine block 12, at least partially defining a cylinder 14. The cylinder 14, which, as shown in FIG. 1 may be a plurality of cylinders 14, can be connected with intake and exhaust components. In some instances, the intake components may include an intake conduit 16 connected to an intake manifold 18 (also referred to as an intake system), and the exhaust components may include a main exhaust conduit 22 connected to an exhaust manifold 20 (also referred to as an exhaust system). The engine 10 includes a crankcase 15 connected to the engine block 12 opposite the cylinder head 13. The crankcase 15 may house a crankshaft (not shown) to move pistons (not shown) within the combustion cylinders 14. As used herein, the term "connected" means fluidly and/or physically connected consistent with the apparatus 10 shown in FIG. 1, unless specified otherwise.

The engine may also include an EGR system 28 branched off of the main exhaust conduit 22. The EGR system 28 may include an EGR conduit 30 connected at one end to the main exhaust conduit 22, and connected at another opposite end to the intake conduit 16. In some instances, the EGR system 28 may also include an EGR cooler 32 configured to cool the exhaust (also referred to as exhaust gas) flowing through the EGR system 28.

As shown in FIG. 1, a crankcase inlet conduit 38 may branch off of the EGR conduit 30 and connect with the crankcase 15. In some instances the crankcase inlet conduit 38 may include a crankcase inlet valve 34 configured to selectively introduce a portion of the exhaust being recirculated through the EGR system 28 into the crankcase 15. The location on the crankcase 15 at which the crankcase inlet conduit 38 connects may be referred to as a crankcase ventilation inlet.

On another side of the crankcase 15 there may be an opening (also referred to as a vent) fluidly connected to the interior of the crankcase 15. A crankcase outlet system 35 may be said to fluidly connect to the crankcase 15 at the vent. The crankcase outlet system 35 may include a crankcase outlet conduit 24 (also referred to as a crankcase ventilation conduit) fluidly connected to the vent, and a crankcase outlet valve 36. The crankcase outlet conduit 24 may connect with the crankcase 15, and the location on the crankcase at which the crankcase outlet conduit 24 connects may be referred to as a crankcase ventilation outlet. Although shown schematically on different sides of the crankcase 15 in FIG. 1, the crankcase inlet conduit 38 and the crankcase outlet conduit 24 may be positioned on the same side of the crankcase 15.

As illustrated in FIG. 1, a controller 41 may be included to electrically connect the crankcase outlet valve 36 to a sensor 40 disposed within the crankcase. The sensor 40, which may be disposed at any location within the crankcase 15, may be configured to detect a concentration of a gaseous constituent located in the crankcase 15. In one instance, the sensor 40 may be an oxygen sensor. Although not shown, the controller 41 may also be electrically connected to the crankcase inlet valve 34.

A separator 26 may also be disposed in the crankcase outlet conduit 24 for separating oil from a crankcase exhaust flow that may flow through the outlet conduit 24, as described in more detail below. The components of the EGR system 28 and the crankcase outlet system 35 described herein, as well as any additional exhaust treatment devices of the engine 10, may collectively constitute the crankcase ventilation system of this disclosure.

The engine 10 may include additional exhaust treatment devices that may further reduce atmospheric emissions. The exhaust treatment devices may be disposed in the main exhaust conduit 22 and/or the crankcase outlet conduit 24 to remove particulate matter and/or to catalyze gases flowing through the conduits 22, 24. For instance, as shown in FIG. 1 the main exhaust conduit 22 may include a particulate filter 27 configured to remove particulate matter, such as soot and/or ash, from the flow of exhaust. The particulate filter 27 may be formed as mesh, a screen, or the like. In some examples, the particulate filter 27 may be catalytic, or a separate catalytic unit (not shown) may be disposed in the main exhaust conduit 22 upstream of the EGR conduit 30 to catalyze the exhaust. Although FIG. 1 shows the particulate filter 27 being disposed upstream of the EGR conduit 30, in some instances the particulate filter 27 and/or any additional separate catalytic unit(s) disposed in the main exhaust conduit 22 may be located downstream of the EGR conduit 30.

As illustrated in FIG. 1, in addition to the particulate filter 27, the engine 10 may include a separate catalytic unit 42 disposed in the crankcase outlet conduit 24 such that the crankcase exhaust may be catalyzed before being vented to the atmosphere. The catalyst used for the particulate filter 27 and/or the catalytic unit 42 may be an oxidation catalyst, such as a diesel oxidation catalyst, configured to remove (i.e. oxidize) pollutants such as HC and/or CO. Alternatively or additionally, a reduction catalyst may also be included for removing (i.e. reducing) pollutants such as $NO_x$. Furthermore, the catalytic unit 42 may be configured to remove soluble organic fraction (SOF), which is primary engine oil. Although not shown in FIG. 1, the catalytic unit 42 may also include a heating device to maintain the catalytic unit 42 at a desired operating temperature (e.g. at least about 150° C.). Any type of heating device may be used, such as electrical heating elements and burners.

A method of operating the engine 10 will now be described. In some instances, this method may be used to purge exhaust and various gaseous constituents (e.g. oxygen) from the crankcase. During operation, air may be drawn from the atmosphere, pressurized by a compressor (not shown), and directed into the combustion cylinders 14 by way of the intake conduit 16 to the intake manifold 18. At any time before, during, and/or after the ingress of pressurized air, fuel may be supplied to and mixed with the air inside combustion cylinders 14. Movement of pistons (not shown) may result in combustion of the fuel/air mixture, and generation of exhaust. The exhaust can flow out of the exhaust manifold 20 and into the main exhaust conduit 22.

From the main exhaust conduit 22, a portion of the exhaust may flow into the EGR conduit 30 to enter the EGR system 28. As shown in FIG. 1, prior to flowing into the EGR system 28 the exhaust may first flow through the particulate filter 27, which, as described above, may be a catalytic particulate filter 27. In the EGR system 28, the exhaust may be cooled as it flows through the EGR cooler 32. Although the engine 10 shown in FIG. 1 includes an EGR cooler 32, in some instances the EGR system 28 may not include an EGR cooler or any other such cooling mechanism.

The flow of exhaust splits at the location where the crankcase inlet conduit 38 branches off of the EGR conduit 30. A portion of the exhaust in the EGR system 28 may flow through the crankcase inlet conduit 38, while a remaining portion of the exhaust may flow through the EGR conduit 30 until reaching the intake conduit 16 to be directed back into the combustion cylinders 14. In some instances, a substantial portion of the exhaust may continue to flow through the EGR conduit 30 until flowing back into the intake conduit 16, while a smaller portion of the exhaust may branch off of the EGR conduit 30 and flow through the crankcase inlet conduit 38 into the crankcase 15. "A substantial portion" of the exhaust may be between about 55% and greater than 95% of the total amount of the exhaust flowing through the EGR system 28. For example, 75% of the exhaust may flow through the EGR conduit 30 and back to the intake conduit 16, while 25% of the exhaust flows through the crankcase inlet conduit 38 and into the crankcase 15. In another example, 95% of the exhaust may flow through the EGR conduit 30 and back to the intake conduit 16, while 5% of the exhaust flows through the crankcase inlet conduit 28 and into the crankcase 15.

The portion of the exhaust, which may be an inert gas having a lower concentration of a given gaseous constituent (e.g. oxygen) than the gas within the crankcase 15, flows through the crankcase inlet conduit 38 and into the crankcase 15. The exhaust may flow through the crankcase 15 and purge the crankcase 15 by pushing gas contained within the crankcase 15 out via the crankcase outlet conduit 24. In particular, the flow of the inert exhaust gas through the crankcase 15 may purge oxygen from the crankcase, while at least some of the accumulated oil vapors remain within the crankcase 15, as described in more detail below.

To control purging of the crankcase 15, which may also be referred to herein as crankcase ventilation, the crankcase inlet valve 34 may be provided in the crankcase inlet conduit 38, and the crankcase outlet valve 36 may be provided in the crankcase outlet conduit 24. Either one or both of the valves 34, 36 may be small, low-flow devices for regulating the flow of exhaust through the crankcase 15. For instance, the crankcase inlet valve 34 may be a low-flow valve such that most of the exhaust gas in the EGR system 28 flows to the intake manifold 16 and not into the crankcase 15.

A predetermined concentration (predetermined value) for a gaseous constituent, such as oxygen, may be set, either directly through the sensor 40 or through a controller 41. The predetermined value may be set at any time prior to or during engine operation. The sensor 40 may sense, either continuously or intermittently, and generate a signal indicative of the concentration of the gaseous constituent (e.g. oxygen) within the crankcase 15. Based on the signal, the controller 41 may be programmed to selectively move the crankcase outlet valve 36. For instance, if the concentration of the gaseous constituent reaches or exceeds the predetermined value, the sensor 40 can send a signal to the controller 41, which can open the crankcase outlet valve 36 to allow a portion of the exhaust gas from the EGR system 28 to flow through the crankcase 15 to purge the crankcase of exhaust contained therein. During the purging, when the concentration of the gaseous constituent is determined to be less than the predetermined value, the sensor 40 may send another signal to the controller 41 to end the purging by closing the crankcase outlet valve 36. In some instances, the predetermined value may be referred to as a first predetermined value, and a second predetermined concentration may be set having a value less than the first predetermined value. The controller 41 may be programmed to close the crankcase outlet valve 36 only when the concentration of the gaseous constituent is determined to be less than the second predetermined value.

In one example, during engine operation both the crankcase inlet valve 34 and the crankcase outlet valve 36 may be closed until receiving a signal from the controller 41, generated from the sensor 40, that a concentration of a gaseous constituent is at or greater than the predetermined value. The controller 41 may then open both valves 34, 36 based on the signal, in order to purge the crankcase 15. In another instance, both the crankcase inlet valve 34 and the crankcase outlet valve 36 may be open during engine operation until receiving a signal from the controller 41, generated from the sensor 40, that a concentration of gaseous constituent is below a predetermined value (e.g. one of the first or second predetermined values). The controller 41 may then close both valves 34, 35 based on the signal. When one of the valves 34, 36 is described as being open, the flow through the valve may be referred to as being unrestricted, unobstructed, free, or the like. When one of the valves 34, 36 is described as being closed, the flow through the valve may be referred to as being restricted, obstructed, impeded, or the like.

Accordingly, based on signals from the sensor 40, the controller 41 may automatically regulate movement (opening and closing) of the crankcase outlet valve 36 and, in some instances, the crankcase inlet valve 34, to control purging of the crankcase 15. When the valves 34, 36 are controlled to selectively regulate crankcase ventilation as described herein, the crankcase ventilation system may be referred to as a closed ventilation system. That is, the flow of recirculated exhaust gas through the crankcase 15 may be interrupted, or intermittent, due to the opening and closing of the crankcase outlet valve 36 and, in some examples, the opening and closing of the crankcase inlet valve 34. In some instances, however, the valves 34, 36 may be continuously open such that the crankcase 15 is continuously ventilated during engine operation, such that the ventilation system may be referred to as an open ventilation system.

As shown in FIG. 1, the exhaust from the crankcase may pass through a separator 26 and a catalytic unit 42 before being exhausted into the atmosphere. The separator 26 may collect oil during the purging, and the catalytic unit 42 may be used to catalyze the exhaust.

INDUSTRIAL APPLICABILITY

The disclosed engine 10 and ventilation system may be used in a variety of industrial applications. For example, the engine 10 and/or ventilation system may be applied to large diesel engines, such as marine diesel engines or locomotive engines. The engine 10 and/or ventilation system may also be used in a variety of stationary power applications.

Instead of using suction to purge the crankcase 15, the engine 10 and ventilation system described herein purge the crankcase 15 by physically forcing recirculated engine exhaust from an engine exhaust manifold through the crankcase 15. The exhaust forced through the crankcase 15 may be an inert gas having a lower concentration of a constituent gas (e.g. oxygen) than the fluid being purged from the crankcase 15. Therefore, the purging may reduce the concentration of a constituent gas within the crankcase.

In addition to reducing the concentration of a constituent gas, such as oxygen, within the crankcase, the engine 10 and ventilation system described herein may also reduce the amount of pollutants, such as oil and oil vapors, exhausted to the atmosphere. For example, if the valves 34, 36 are constantly opened such that the crankcase 15 is continuously purged by recirculated exhaust, some oil vapor may remain in the crankcase 15. Although some oil vapor may also be exhausted from the crankcase during purging, the separator 26, catalytic unit 42, and other components included along the crankcase outlet conduit 24 may help to reduce the amount of pollutants that are emitted to the atmosphere. As another example, if the controller 41 controls movement of the valves 36, 38 based on signals from the sensor 40 located within the crankcase 15, the crankcase 15 may be intermittently purged. By intermittently purging the crankcase 15, the concentration of a constituent gas (e.g. oxygen) may be reduced while retaining a greater amount of oil and oil vapor within the crankcase 15. For instance, when the controller 41 closes the crankcase outlet valve 36 based on a signal from the sensor 40, exhaust, oil, and oil vapors may remain within the crankcase 15. While some amount of pollutants, such as oil vapor, may still exit the crankcase 15 during purging when the crankcase outlet valve 36 is open, because the flow through the crankcase 15 may be intermittent rather than continuous, the amount of pollutants exhausted to the atmosphere may be reduced.

Although, as described above, the crankcase 15 may be purged when the concentration of a gaseous constituent within the crankcase 15 exceeds a predetermined concentration, alternatively, the crankcase may be purged based on a given number of engine cycles or a predetermined amount of time. The predetermined amount of time at which to purge the crankcase may be preset via the controller 41, such that the controller 41 may send a signal to move (open or close) the crankcase outlet valve 36 after the predetermined amount of time has elapsed. Additionally, although crankcase exhaust may be vented directly to the atmosphere, in some instances the crankcase exhaust may first pass through an exhaust stack or tailpipe before being vented to the atmosphere.

It will be apparent to those skilled in the art that various modifications and variations can be made to the disclosed engine system and method. Other embodiments will be apparent to those skilled in the art from consideration of the specification and practice of the disclosed engine system and method. It is intended that the specification and examples be considered as exemplary only, with a true scope being indicated by the following claims and their equivalents.

What is claimed is:

1. A ventilation system for an engine, comprising:
- a first conduit configured to connect an exhaust system of the engine with a crankcase of the engine;
- a second conduit configured to connect to a vent of the crankcase;
- a valve disposed within the second conduit;
- a sensor configured to generate a signal indicative of a concentration of oxygen within the crankcase of the engine; and
- a controller in communication with the valve and the sensor, the controller being configured to selectively move the valve based on the signal.

2. The ventilation system of claim 1, wherein the valve is configured to regulate a flow out of the crankcase.

3. The ventilation system of claim 1, comprising an additional valve disposed within the first conduit and configured to regulate the flow of exhaust into the crankcase.

4. The ventilation system of claim 1, wherein the controller is configured to open the valve when the signal indicates that the concentration of oxygen within the crankcase is greater than a predetermined concentration.

5. The ventilation system of claim 1, wherein the controller is configured to close the valve when the signal indicates that the concentration of oxygen within the crankcase is less than a predetermined concentration.

6. An engine, comprising:
- an engine block;
- a cylinder head connected to the engine block and, together with the engine block, at least partially defining a cylinder;
- a crankcase connected to the engine block opposite the cylinder head;
- an exhaust system fluidly connected to the cylinder head;
- a vent fluidly connected to an interior of the crankcase;
- a first conduit fluidly connected between the exhaust system and the crankcase;
- a second conduit fluidly connected to the vent;
- a valve disposed within the second conduit;
- a sensor configured to generate a signal indicative of a concentration of oxygen within the crankcase; and
- a controller in communication with the valve and the sensor, the controller being configured to selectively move the valve based on the signal.

7. The engine of claim 6, wherein the valve is configured to regulate a flow out of the crankcase.

8. The engine of claim 6, comprising an additional valve disposed within the first conduit and configured to regulate the flow of exhaust into the crankcase.

9. The engine of claim 6, wherein the controller is configured to open the valve when the signal indicates that the concentration of oxygen within the crankcase is greater than a predetermined concentration.

10. The engine of claim 6, wherein the controller is configured to close the valve when the signal indicates that the concentration of oxygen within the crankcase is less than a predetermined concentration.

11. The engine of claim 6, comprising an exhaust gas recirculation system configured to direct a portion of exhaust from the exhaust system to the crankcase, and configured to direct a remaining portion of the exhaust from the exhaust system to an intake system.

12. A method of purging an engine crankcase, comprising:
- directing a flow of exhaust from an engine into the engine crankcase;
- sensing a concentration of oxygen within the engine crankcase; and
- selectively restricting the flow of exhaust out of the crankcase based on the concentration.

13. The method of claim 12, further comprising directing an additional flow of the exhaust from the engine into an engine intake manifold.

14. The method of claim 13, wherein an amount of the flow of exhaust directed into the engine crankcase is less than an amount of the additional flow of exhaust directed into the intake manifold.

15. The method of claim 12, wherein the flow of exhaust is unrestricted when the concentration of oxygen exceeds a predetermined value.

16. The method of claim 12, wherein the flow of exhaust is restricted when the concentration of oxygen is less than a predetermined value.

* * * * *